US008939852B1

(12) United States Patent
Waggoner

(10) Patent No.: US 8,939,852 B1
(45) Date of Patent: Jan. 27, 2015

(54) PUTTING GREEN ALIGNMENT TOOL

(71) Applicant: Michael Waggoner, Burkburnett, TX (US)

(72) Inventor: Michael Waggoner, Burkburnett, TX (US)

( * ) Notice: Subject to any disclaimer, the term of this patent is extended or adjusted under 35 U.S.C. 154(b) by 0 days.

(21) Appl. No.: 13/716,119

(22) Filed: Dec. 15, 2012

Related U.S. Application Data

(60) Provisional application No. 61/592,686, filed on Jan. 31, 2012.

(51) Int. Cl.
*A63B 57/00* (2006.01)

(52) U.S. Cl.
CPC ..... *A63B 57/00* (2013.01); *A63B 57/0068* (2013.01); *A63B 57/0075* (2013.01)
USPC ..... 473/408; 473/404

(58) Field of Classification Search
USPC ..... 473/404, 406, 408, 286, 316, 340, 313; 33/391, 398
See application file for complete search history.

(56) References Cited

U.S. PATENT DOCUMENTS

| | | | | | |
|---|---|---|---|---|---|
| 1,064,916 | A * | 6/1913 | Kelly | 473/342 |
| 1,116,452 | A * | 11/1914 | Lorraine | 33/391 |
| 1,481,716 | A * | 1/1924 | Ketchum | 33/391 |
| 2,204,974 | A * | 6/1940 | Strasser | 473/293 |
| 3,186,092 | A * | 6/1965 | Bertas | 473/404 |
| 3,535,792 | A * | 10/1970 | Douglas | 33/391 |
| 3,550,940 | A * | 12/1970 | Ball | 473/609 |
| 3,700,244 | A * | 10/1972 | Liotta | 473/240 |
| 3,759,527 | A * | 9/1973 | Witherspoon | 473/306 |
| 3,870,299 | A * | 3/1975 | Howe | 473/257 |
| 4,725,062 | A * | 2/1988 | Kinney, III | 473/330 |
| 4,927,151 | A * | 5/1990 | Ronnick | 473/241 |
| 5,026,064 | A * | 6/1991 | Novosel | 473/409 |
| 5,225,626 | A * | 7/1993 | Bowers | 33/392 |
| 5,409,212 | A * | 4/1995 | Arnett | 473/404 |
| 5,520,384 | A * | 5/1996 | Wetzel | 473/404 |
| 5,733,208 | A * | 3/1998 | Fazekas | 473/406 |
| 5,792,015 | A * | 8/1998 | Hoyt et al. | 473/404 |
| 6,223,829 | B1 * | 5/2001 | Wiens | 473/286 |
| 6,383,086 | B1 * | 5/2002 | Flood | 473/330 |
| 2002/0111227 | A1 * | 8/2002 | Wilson | 473/316 |
| 2003/0013558 | A1 * | 1/2003 | Viljoen | 473/404 |
| 2006/0073916 | A1 * | 4/2006 | Lin | 473/404 |

* cited by examiner

*Primary Examiner* — Steven Wong
(74) *Attorney, Agent, or Firm* — Kenneth L Tolar

(57) ABSTRACT

A putting alignment tool includes a pair of spaced, telescoping arms each having an upper end and a lower end. The upper ends are joined with a horizontal bubble level having a divot-repair fork hingedly attached thereto. Magnetically attached to the divot-repair fork is a ball marker. The lower ends of the arms are joined with a weighted ball that maintains the tool in a vertical orientation when the tool is suspended. Accordingly, a golfer extends the arms to a desired length and suspends the tool by grasping the upper end. The bubble level allows the golfer to verify that the weighted arms are indeed vertical. Then, the ball and cup are framed between the two arms to determine the optimum putting path.

4 Claims, 2 Drawing Sheets

PUTTING GREEN ALIGNMENT TOOL

CROSS REFERENCE TO RELATED APPLICATIONS

This application is entitled to the benefit of provisional patent application No. 61/592,686 filed on Jan. 31, 2012, the specification of which is incorporated herein by reference.

BACKGROUND OF THE INVENTION

The present invention relates to a putting aid for assisting a golfer with aligning a golf ball with a cup.

DESCRIPTION OF THE PRIOR ART

To determine the slope of a putting green, a golfer often suspends a putter vertically, i.e., plumb bobs, while aligning the ball with the cup. However, the technique is notoriously inaccurate since the golfer must typically hold the putter on one side of the ball. Accordingly, there is currently a need for a device that more accurately determines an optimum path for a golf ball resting on a putting green. The present invention addresses this need by providing a tool formed of a pair of weighted, extendable arms that are properly oriented with a bubble level to assist the golfer with alignment.

SUMMARY OF THE INVENTION

The present invention relates to a putting alignment tool comprising a pair of spaced, telescoping arms each having an upper end and a lower end. The upper ends are joined with a horizontal bubble level having a divot-repair fork hingedly attached thereto. Magnetically attached to the divot-repair fork is a ball marker. The lower ends of the arms are joined with a weighted ball that maintains the arms in a vertical orientation when the tool is suspended. Accordingly, a golfer extends the arms to a desired length and suspends the tool by grasping the upper end. The bubble level allows the golfer to verify that the weighted arms are indeed vertical. Then, the ball and cup are framed between the two arms to determine the optimum putting path.

It is therefore an object of the present invention to provide a tool that assists a golfer with aligning a putt.

It is another object of the present invention to provide a tool that more accurately determines the slope of a putting green.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 1:
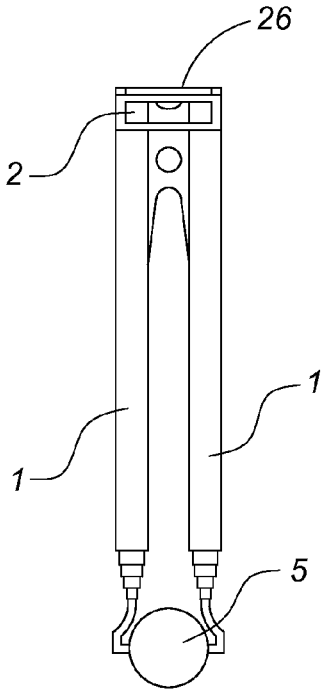
FIG. 1 is a rear, plan view of the tool according to the present invention.
Figure 2:
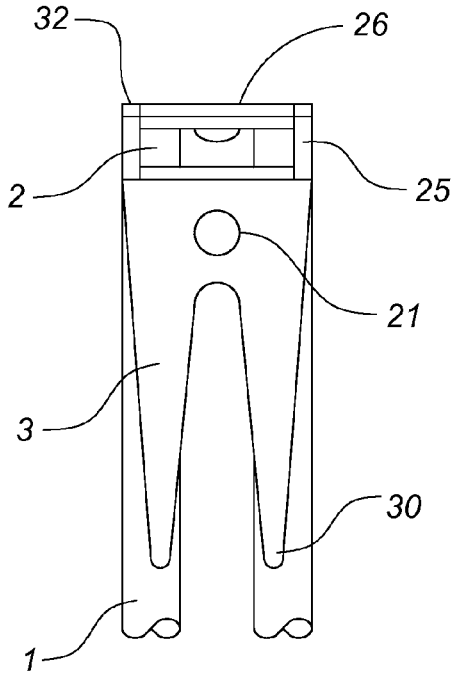
FIG. 2 is a front, sectional view of the tool.
Figure 3:
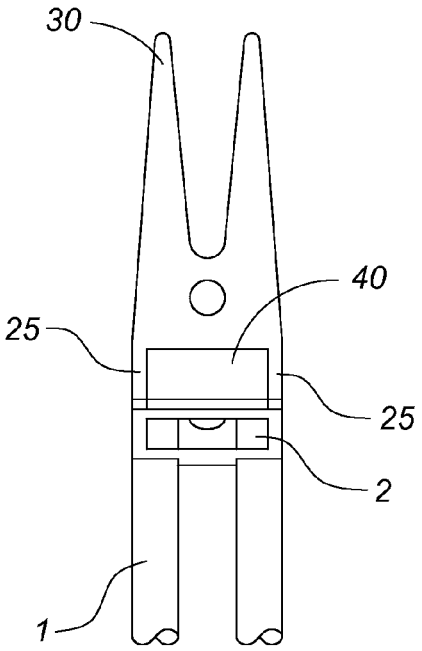
FIG. 3 is a front, sectional view of the tool with the divot-repair tool in a deployed position.
Figure 4:
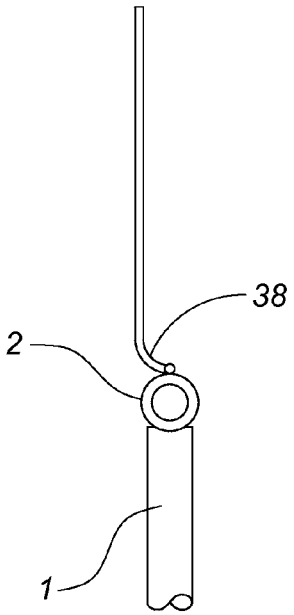
FIG. 4 is a side view of the tool with the divot-repair tool in a deployed position.
Figure 5:
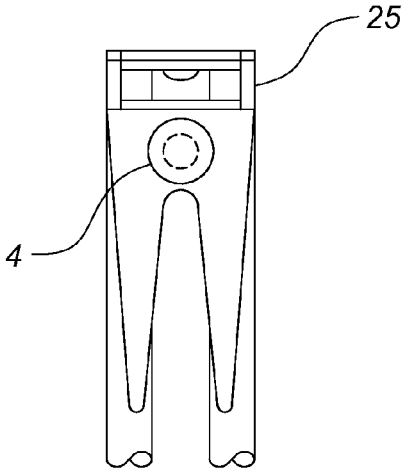
FIG. 5 depicts the tool of FIG. 2 with the ball marker positioned within the mating receptacle.
Figure 6:
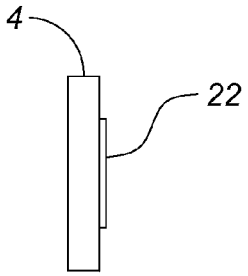
FIG. 6 is an isolated, side view of the ball marker.

The present invention relates to a putting alignment tool comprising a pair of spaced, telescoping arms 1, each having an upper end and a lower end. The upper ends are joined with a horizontal bubble level 2 having a divot-repair fork 3 hingedly attached thereto. The divot-repair fork includes a pair of prongs 30 at a lower end for penetrating soil and a pair of spaced flanges 25 at an upper end. The divot-repair fork is preferably constructed with a ferromagnetic material for attracting a magnetic ball marker described in more detail, infra. Each flange includes a hinge ring 32 thereon that receives a hinge pin 26 attached to the bubble level casing. The flanges form an opening 40 therebetween that exposes the bubble level when the divot-repair fork is collapsed against the arms. Furthermore, the flanges have an arcuate portion 38 that conforms to the bubble level when the divot-repair fork is collapsed for storage.

Between the hinge rings and prongs is a small receptacle 21 that removably receives a magnetic ball marker 4. On a rear surface of the ball marker is a thin disc 22 that tightly seats within the receptacle 21 to assist a user with properly reattaching the ball marker for storage. The lower ends of the arms are joined with a weighted ball 5 that maintains the tool in a vertical orientation whenever it is tenuously grasped by the top end.

Accordingly, a golfer extends the arms to a desired length and suspends the tool by grasping the bubble level or another portion of the upper end. The bubble level allows the golfer to verify that the weighted arms are indeed vertical. Then, the ball and cup are framed between the two arms to determine the optimum putting path. If needed, the divot-repair fork is deployed and the arms are collapsed to form a handle that is grasped to insert the prongs into a divot. When the divot-repair fork is collapsed against the arms for storage, it forms a hanger for suspending the tool from a trouser or golf-bag pocket.

The above-described device is not limited to the exact details of construction and enumeration of parts provided herein. Furthermore, the size, shape and materials of construction of the various components can be varied.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A putting alignment tool comprising:

a pair of spaced, elongated telescopic arms, each of said arms having an upper end and a lower end;

a weighted member joining the lower end of one of said arms with the lower end of another of said arms, said weighted member maintaining said arms in a vertical orientation when the upper end of each of said arms is grasped by a user, wherein said weighted member is a weighted ball that maintains the arms in a vertical orientation;

a bubble level joining the upper end of one of said arms with the upper end of another of said arms for further assuring that said arms are suspended in a vertical orientation;

a divot-repair fork hingedly attached to said bubble level that is collapsible against said arms.

2. The putting alignment tool according to claim 1 wherein said divot-repair fork includes a receptacle having a magnetic ball marker removably received therein.

3. The putting alignment tool according to claim 2 wherein said ball marker includes a thin disc on a rear surface that tightly seats within said receptacle.

4. The putting alignment tool according to claim 2 wherein said divot-repair fork is constructed with a ferromagnetic material to adhere to said ball marker.

* * * * *